US007543861B2

(12) United States Patent
Dupont et al.

(10) Patent No.: US 7,543,861 B2
(45) Date of Patent: Jun. 9, 2009

(54) LOCK FOR AN OPENING ON A MOTOR VEHICLE, WITH A MEMORY FOR UNLOCKING LOCKING

(75) Inventors: Patrick Dupont, Noyelles sur Mer (FR); Nicolas Lejeune, Montcavrel (FR)

(73) Assignee: Valeo Securite Habitacle, Creteil (FR)

( * ) Notice: Subject to any disclaimer, the term of this patent is extended or adjusted under 35 U.S.C. 154(b) by 16 days.

(21) Appl. No.: 10/545,277

(22) PCT Filed: Mar. 22, 2004

(86) PCT No.: PCT/EP2004/050344

§ 371 (c)(1),
(2), (4) Date: Aug. 11, 2005

(87) PCT Pub. No.: WO2004/085774

PCT Pub. Date: Oct. 7, 2004

(65) Prior Publication Data

US 2006/0049642 A1 Mar. 9, 2006

(30) Foreign Application Priority Data

Mar. 27, 2003 (FR) ..... 03 03970

(51) Int. Cl.
*E05C 3/06* (2006.01)
*E05C 3/16* (2006.01)

(52) U.S. Cl. ..... 292/216; 292/DIG. 23; 292/DIG. 61

(58) Field of Classification Search ..... 292/216, 292/DIG. 23, DIG. 61
See application file for complete search history.

(56) References Cited

U.S. PATENT DOCUMENTS

| | | | | |
|---|---|---|---|---|
| 3,334,934 | A * | 8/1967 | Sandor | 292/216 |
| 3,591,220 | A * | 7/1971 | Sandor | 292/216 |
| 4,413,694 | A * | 11/1983 | Slocombe et al. | 180/89.14 |
| 5,803,515 | A | 9/1998 | Arabia, Jr. et al. | |
| 5,967,572 | A * | 10/1999 | Sajfert et al. | 292/336.3 |
| 6,328,354 | B1 * | 12/2001 | Dejean et al. | 292/216 |
| 6,367,296 | B1 * | 4/2002 | Dupont | 70/257 |
| 6,428,058 | B1 | 8/2002 | Graute | |
| 6,554,329 | B1 | 4/2003 | DeBlock et al. | |

(Continued)

FOREIGN PATENT DOCUMENTS

| | | |
|---|---|---|
| EP | 0834631 | 4/1998 |

(Continued)

*Primary Examiner*—Carlos Lugo
(74) *Attorney, Agent, or Firm*—Berenato, White & Stavish, LLC

(57) ABSTRACT

The lock includes an opening lever and a locking lever capable of displacing a connecting rod between a first position, in which the opening lever can cooperate with the connecting rod to cause the opening of the lock, and a second position which prevents the opening of the lock, blocking means for preventing a displacement of the rod between the first and second positions when the opening lever is put into an opening position before the locking lever is actuated, and an elastic device capable of memorizing both an unlocking action and a locking action when the locking lever is actuated while the connecting rod is being blocked by storing an unlocking energy or a locking energy in response to the actuation of the locking lever to automatically cause an unlocking or a locking of the lock when the opening lever returns into a position of rest.

15 Claims, 6 Drawing Sheets

U.S. PATENT DOCUMENTS

| | | | | |
|---|---|---|---|---|
| 6,592,157 | B1 * | 7/2003 | Spurr | 292/216 |
| 6,805,386 | B2 * | 10/2004 | Ehret et al. | 292/216 |
| 2001/0030428 | A1 | 10/2001 | Kunst et al. | |

FOREIGN PATENT DOCUMENTS

| | | |
|---|---|---|
| EP | 1101890 | 5/2001 |
| EP | 1143093 | 10/2001 |
| FR | 2789716 | 8/2000 |

* cited by examiner

LOCK FOR AN OPENING ON A MOTOR VEHICLE, WITH A MEMORY FOR UNLOCKING LOCKING

The present invention relates in general terms to locks for an opening on a motor vehicle, with mechanical or electrical control of opening and/or of locking/unlocking.

In some locks for a motor vehicle door, when the vehicle locks are in a locked state and an external handle or keeper of one of the vehicle doors is actuated before an unlocking command is transmitted to the lock of the door, the handle or keeper of which has been actuated, the external opening lever of the lock, connected to the handle or keeper which has been actuated, may block the unlocking mechanism of the corresponding lock, thus preventing the opening of said lock and consequently preventing the opening of the corresponding door.

For example, with regard to a lock of this type with electrical locking/unlocking control, should a user of a vehicle approach the vehicle and attempt to open a door of the latter by actuating the external handle or keeper of the door before the vehicle driver has controlled the unlocking of the vehicle locks with the aid of a remote control box or with the aid of a key, when the unlocking command reaches the various vehicle locks the electric motors of the locks cause the unlocking of the locks of the doors, the external handle or keeper of which has not been actuated, whereas the unlocking of the lock, the external handle or keeper of which is maintained actuated, remains locked.

So the lock which has remained locked can be unlocked and opened, the user must first of all release the external handle or keeper of the door, and then the driver must successively relock all the locks with the aid of the remote control or the key, then once again unlock all the locks with the aid of the remote control or the key, after which all the locks can be opened by actuating the handles or keepers of the door. All these operations delay the entry of the user or users and of the driver into the vehicle and are therefore considered troublesome, especially in emergencies, for example when the user or users and the driver are forced to shelter inside the vehicle, for example because of bad weather.

The document FR 2 789 716 describes a lock which makes it possible to implement the unlocking function of the lock, even when a member of the lock blocks the kinematic chain for opening the lock, thus making it possible to overcome the disadvantage referred to above. For this purpose, under the circumstances mentioned above, an elastic device provided in this known lock memorizes the unlocking action and executes the latter as soon as the external keeper or handle is released. The result of this is that the lock which had remained locked can be opened immediately by reactuating the external handle or keeper of the door a second time, without the need for the driver to relock and unlock again all the locks with the aid of the remote control or the key.

The problem which now arises is to allow the locking of a lock even when a member of the lock blocks the kinematic chain for locking the lock. Such a situation may occur, for example, when a person locks the locks of his vehicle with the aid of the key or the remote control when another person, who, for example, has forgotten something in the passenger compartment of the vehicle or who wishes to take something from the trunk is in the process of actuating the external handle or keeper of a door or of the trunk of the vehicle, or else when another person who has remained inside the passenger compartment of the vehicle is in the process of actuating the internal handle or keeper for opening a door of the vehicle. In either of these situations, all the locks of the vehicle are locked, except that of the door or trunk, the handle or keeper of which was actuated at the moment of locking.

The object of the present invention is, therefore, to propose a lock for an opening on a motor vehicle, which makes it possible to implement the locking function of the lock, even when a member of the lock blocks the kinematic chain for locking the lock.

For this purpose, the subject of the invention is a lock for an opening on a motor vehicle, comprising a locking lever moveable between a first position corresponding to an unlocked state of the lock and a second position corresponding to a locked state of the lock, and a connecting rod which, in response to a displacement of the locking lever between its first and second positions, is displaceable between a first active position and a second inactive position, characterized in that it comprises an elastic device capable of storing a locking energy in the event of the blocking of the connecting rod in its first active position, in order automatically to cause the displacement of the connecting rod from its first active position to its second inactive position after the unblocking of the connecting rod.

The lock according to the invention may comprise, furthermore, alone or in combination, the following characteristics:

- the elastic device is also capable of storing an unlocking energy in the event of the blocking of the connecting rod, in order automatically to cause the displacement of the connecting rod from its second inactive position to its first active position after the unblocking of the connecting rod,
- the elastic device comprises a helical torsion spring with two branches, which connects the locking lever directly to the connecting rod,
- one of the branches serves for driving the connecting rod from its second inactive position to its first active position, and the other (21*b*) of the two branches serves for driving the connecting rod from its first active position to its second inactive position,
- the two branches of the helical torsion spring are crossed, as seen in the axial direction,
- the locking lever has substantially the form of a disk comprising a central hub, a slot which is formed in the disk and which extends in an arc of a circle about a part of the central hub, and at least one drive part which projects on said face of the disk, mid-way along at least one longitudinal edge of the arcuate slot,
- the helical torsion spring is arranged around the central hub of the locking lever, in such a way that the two branches of said helical torsion spring grip between them said drive part of the locking lever and pass radially through the arcuate slot,
- the connecting rod comprises, at one of its ends, a first coupling stud which passes through the arcuate slot of the locking lever between the two branches of the helical torsion spring and, at its other end, a second coupling stud which passes through an oblong slot formed longitudinally in an opening lever, said oblong slot extending in a first direction allowing the displacement of the connecting rod from its first to its second position when the opening lever is in the position of rest and in a second direction preventing said displacement of the connecting rod when the opening lever is in the opening position,
- the lock comprises a latch, a pawl capable of retaining the latch in a position corresponding to a closed state of the lock, and an opening lever moveable under the action of an opening control means between a position of rest and an opening position of the lock, characterized in that the lock comprises, furthermore, a dummy pawl, and in that the pawl, the dummy pawl and the opening lever are mounted in this order on a common pivoting shaft, the dummy pawl being integral in terms of rotation with the pawl and comprising a tab, on which the second coupling stud of the connecting rod acts in order to cause the displacement of the dummy pawl and of the pawl toward the release position of the latch when the connecting rod is in its first position and the opening lever is displaced from the position of rest to the opening position, said tab comprises a stop surface arranged to fulfill the function of said blocking member, the opening lever is an external opening lever intended to be connected by means of a force transmission member to a member for the external opening control of a motor vehicle door.

Other characteristics of the lock will become apparent from the following description of an embodiment given by way of example, with reference to the accompanying drawings in which.

Figure 1:
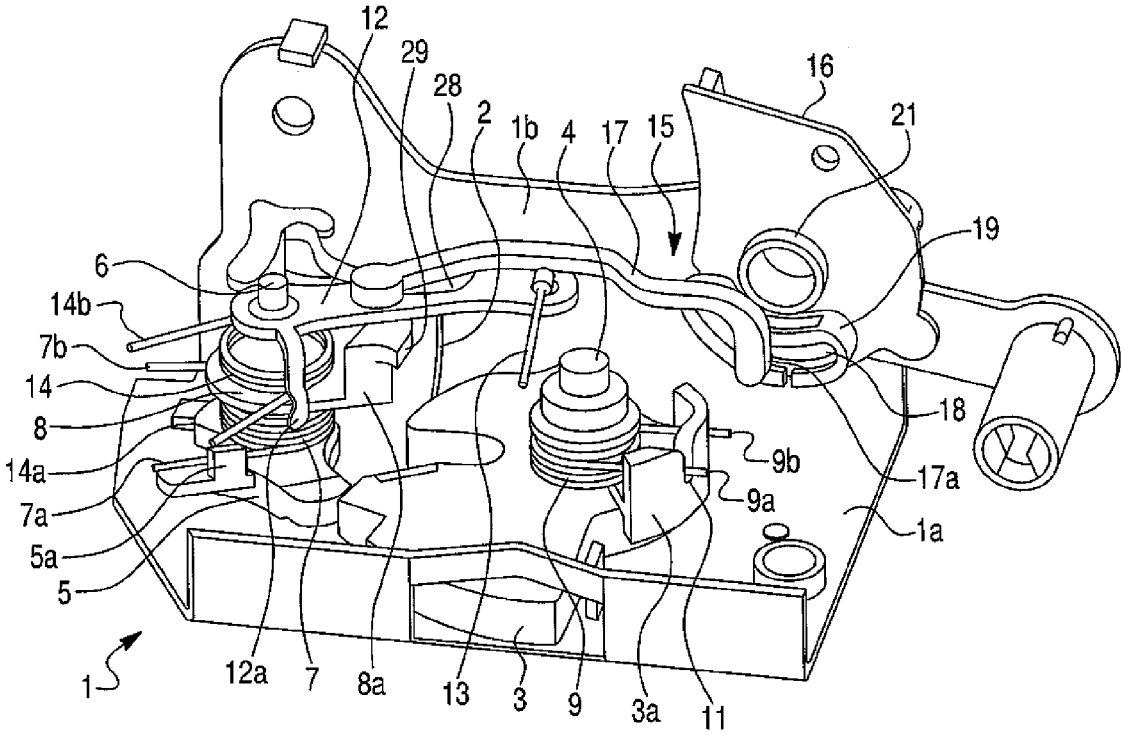
FIG. 1 is a perspective view of a lock according to one embodiment of the invention.

Referring first of all to FIG. 1, it can be seen that the lock comprises a board 1 made from sheet metal, suitably cut out and bent, which forms part of the lock case intended to be fastened to the edge of a door, not shown, of a motor vehicle. The board 1 comprises a base part 1*a* and a wing 1*b* bent at 90° with respect to the base part 1*a*. An orifice 2 is formed partially in the base part 1*a* and partially in the wing 1*b* of the board 1, for the passage of a striker (not shown) which is normally fastened to the body of the vehicle and which, during operation, cooperates with a forked-shaped latch 3 of the lock in order to retain the door equipped with the lock in the closed position. The latch 3 is mounted pivotably on a shaft 4, one end of which is seated in a hole, not shown, of the base part 1*a* of the board 1, the other end of the shaft 4 being seated in another hole of another part, not shown, of the lock case.

In the closed state of the lock (FIGS. 1, 3-5, 7 and 12), the latch 3 is maintained in a position for the retention of the striker by means of a pawl 5 which is mounted pivotably on a shaft 6, one end of which is seated in a hole, not shown, of the base part la of the board 1, the other end of the shaft 6 being seated in another hole of said other part of the lock case. The pawl 5 is stressed by a first spring 7 toward the position illustrated in FIG. 1, in which it retains the latch 3 in the position for the retention of the striker. The spring 7 may consist, for example, of a helical torsion spring which surrounds the shaft 6 and which comprises a branch 7*a* bearing on a tab 5*a* of the pawl 5 and another branch 7*b* bearing on an abutment, not shown, provided on the lock case, for example on the board 1.

The lock comprises, furthermore, a dummy pawl 8 which is likewise mounted pivotably on the shaft 6 and which is integral in terms of rotation with the pawl 5. The dummy pawl 8 comprises a tab 8*a*, on which it is possible to act, as will be seen later, in order to cause the dummy pawl 8 and the pawl 5 to pivot together counter to the return force of the spring 7, in order to bring the pawl 5 into a position in which it releases the latch 3. When the pawl 5 is in the position for the release of the latch 3, the latter can pivot about the shaft 4 under the action of a second spring 9 which brings the latch 3 to a position in which it releases the striker and thus makes it possible to open the door. The spring 9 may consist, for example, of another helical torsion spring which is arranged around the shaft 4 and which comprises a branch 9*a* engaged in a notch 11 of a protuberance 3*a* which projects on one side of the latch 3 and which forms an integral part thereof, and another branch 9*b* bearing on the abutment, not shown, provided in the lock case, for example on the board 1.

The lock comprises, furthermore, an external opening lever 12 which is likewise mounted pivotably on the shaft 6. When the lock is in operation, the external opening lever 12 is connected by means of a force transmission member 13, partially shown in FIGS. 1, 3-5, 7-9, 11 and 12, to a member for external opening control, not shown, which consists, for example, of an external handle or keeper of the door equipped with the lock. The force transmission member 13 may consist, for example, of a linkage or a Bowden cable. Only that end part of the linkage or of the cable 13 which is attached to the external opening lever 12 is illustrated in the abovementioned figures.

During operation, the external opening lever 12 can be displaced by the force transmission member 13 from a position of rest (FIGS. 1, 3, 7, 11 and 12) to an opening position (FIGS. 4, 5, 8 and 9). When the lock is in an unlocked state, the displacement of the external opening lever 12 from the position of rest to the opening position causes the lock to change from its closed state to its opened state in a way which will be described later.

A third spring 14 may be provided in order to stress the external opening lever toward its position of rest. The spring 14 may consist, for example, of a helical torsion spring arranged around the shaft 6 and comprising a branch 14*a* bearing on a tab 12*a* of the external opening lever 12 and another branch 14*b* bearing on an abutment, not shown, provided in the lock case.

The lock comprises, furthermore, a locking mechanism 15 comprising a locking lever 16 which is coupled to one end of a connecting rod 17, the other end of which is coupled to the external opening lever 12.

Figure 2:
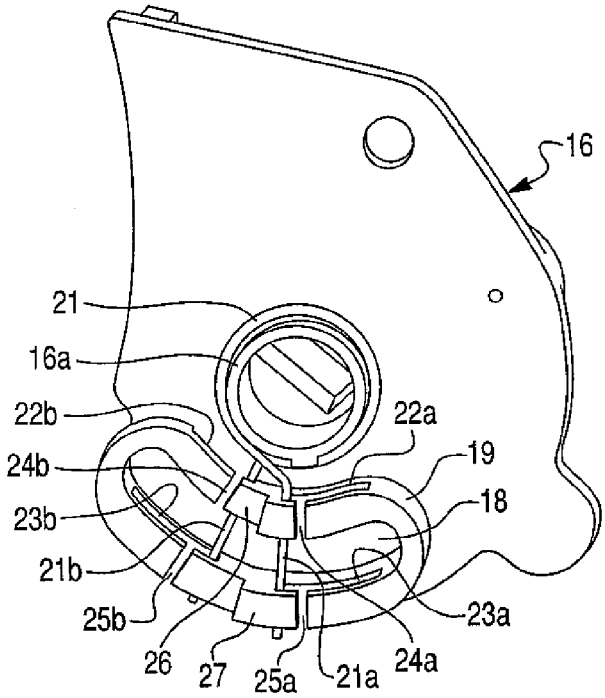
FIG. 2 is a perspective view showing, on a larger scale than FIG. 1, a locking lever with a spring which form part of the lock of FIG. 1.

As can be seen particularly in FIG. 2, the locking lever 16 has substantially the form of a disk comprising a central hub 16a which projects on one face of the disk for mounting the locking lever on a rotary shaft, not shown, carried by the wing 1*b* of the board 1. During operation, the locking lever 16 can be rotated mechanically or electromechanically on the abovementioned rotary shaft from a first position or unlocking position, corresponding to an unlocked state of the lock (FIGS. 1, 7-9), to a second position or locking position, corresponding to a locked state of the lock (FIGS. 3-5, 11 and 12). The displacement (rotation) of the lever 16 from its unlocking position to its locking position, and vice versa, can be obtained in a known way manually by means of a trim strip pull fastener, not shown, connected directly or indirectly to the locking lever 16, and/or mechanically by means of a barrel actuated by a key and/or electromechanically by means of an actuator, such as an electromagnet or an electromotor/reducer assembly controlled by a central control unit in response to the reception by the latter of a valid remote control signal transmitted by remote control or in response to a valid identification signal transmitted by an identification member of a hands-free access system.

In the disk of the locking lever 16, a slot 18 is formed, which extends in an arc of a circle about a part of the central hub 16*a* of the disk. Preferably, the slot 18 is also formed in a substantially bean-shaped protuberance 19 which projects on the same face of the disk as the hub 16*a*, as shown in FIG. 2.

An elastic device 21 carried by the locking lever 16 connects the latter to the connecting rod 17 directly and elastically. As can be seen more clearly in FIG. 2, the elastic device 21 comprises a helical torsion spring with two branches, which is arranged around a central hub 16*a* of the locking lever 16, in such a way that the two branches 21*a* and 21*b* of the spring 21 pass radially through the arcuate slot 18.

Each of the two branches 21*a* and 21*b* of the spring 21 is free to be displaced over a limited angle in two chinks 22*a*, 23*a* and 22*b*, 23*b* respectively, which are formed in the arcuate walls of the protuberance 19. The abovementioned limited angle corresponds to the angle of rotation of the locking lever 16 between the two end locking and unlocking positions. Four notches 24*a*, 25*a* and 24*b*, 25*b* are also provided in the arcuate walls of the protuberance 19 and communicate respectively with the chinks 22*a*, 23*a* and 22*b*, 23*b* in order to make it possible to put the spring 21 in place around the central hub 16*a* of the locking lever 16 and put the branches 21*a* and 21*b* of said spring in place in the abovementioned chinks. Once in place, the two branches 21*a* and 21*b* of the spring 21 grip between them the two parts 26 and 27 of the protuberance 19 which are substantially mid-way along the longitudinal edges of the arcuate slot 18, between the chinks 22*a* and 22*b* and the chinks 23*a* and 23*b* respectively. As will be seen later, the two parts 26 and 27 of the protuberance 19 form drive parts for one or other of the two branches 21*a* and 21*b* of the spring 21, depending on the direction of rotation of the locking lever 16.

Preferably, the branches 21*a* and 21*b* of the spring 21 are crossed, as shown in FIG. 2. More specifically, the branch 21*a* which comes from that part of the spring 21 which is located on the left side (looking at FIG. 2) of the hub 16*a* of the locking lever 16 is engaged in the chinks 22*a* and 23*a* which are located on the right side of the protuberance 19, while the branch 21*b* which comes from that part of the spring 21 which is located on the right side of the hub 16*a* is engaged in the chinks 22*b* and 23*b* located on the left side of the protuberance 19.

Referring once again to FIG. 1, it can be seen that the connecting rod 17 comprises, at one end, a coupling stud 17*a* which passes through the arcuate slot 18 of the locking lever 16 between the two branches 21*a* and 21*b* of the spring 21. The connecting rod 17 comprises, at its other end, a second coupling stud 17*b* (which cannot be seen in FIG. 1, but can be seen clearly particularly in FIGS. 3 and 4) which passes through an oblong slot 28 formed longitudinally in the external opening lever 12 and which projects beneath said external opening lever. Advantageously, the two coupling studs 17*a* and 17*b* may be quarter-turn studs. More specifically, each of the two studs 17*a* and 17*b* comprises, at its free end, a radial projection which, after passing through the arcuate slot 18 or through the oblong slot 28 and after a relative rotation of approximately one quarter turn of the coupling stud 17*a* or 17*b* with respect to the locking lever 16 or to the external opening lever 12, catches behind said lever 16 or 12 in order, during operation, to prevent the coupling stud from being disengaged inopportunely from the corresponding slot 18 or 28.

When the external opening lever 12 is in the position of rest (FIG. 1), the oblong slot 28 extends in a direction allowing the displacement of the connecting rod 17 by means of the locking lever 16 from a first active position (FIG. 1) corresponding to an unlocked state of the lock to a second inactive position (FIG. 3) corresponding to a locked state of the lock. It will be noted that, in the first position of the connecting rod 17 (FIG. 1), the coupling stud 17*b* of the rod 17 and the tab 8*a* of the dummy pawl 8 are located next to one another and at equal radial distances with respect to the shaft 6. The result of this is that, when the external opening lever 12 is displaced angularly from the position of rest (FIG. 7) to the opening position (FIG. 8) by means of the force transmission member 13, the coupling stud 17*b* comes into contact with the tab 8*a* of the dummy pawl and causes the latter and the pawl 5 to pivot about the shaft 6, in order to release the lock latch 3 which, in turn, releases the striker, thus making it possible to open the vehicle door.

When the connecting rod 17 is in the second inactive position (FIG. 3) corresponding to the locked state of the lock, the coupling stud 17*b* of the rod 17 is at a greater radial distance from the shaft 6 than the tab 8*a* of the dummy pawl 8. Under these conditions, when the external opening lever 12 is displaced angularly from the position of rest (FIG. 3) to the opening position (FIG. 4) by means of the force transmission member 13, the coupling stud 17*b* of the rod 17 passes in front of the tab 8*a* without acting on the latter, so that the displacement of the external opening lever 12 has no effect on the dummy pawl 8 and the pawl 5. The latch 3 therefore remains blocked by the pawl 5 in the position for the retention of the striker, and the lock remains closed.

The functioning of the lock in the two critical situations addressed at the start of the present specification will now be described. The situation will first be described, with reference to FIGS. 3 to 8, where an unlocking action occurs when the external opening lever 12 has already been actuated and is still in the opening position, and then the situation will be described, with reference to FIGS. 7 to 12, where a locking action occurs when the external opening lever has already been actuated and is maintained in the opening position.

Figure 3:
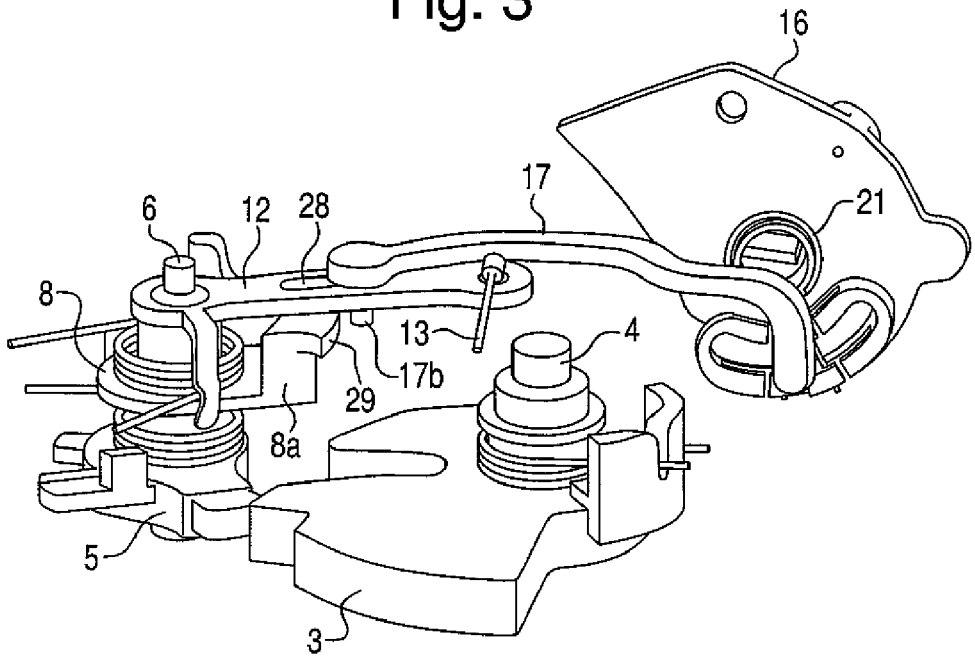
FIG. 3 is a perspective view showing the components of the various mechanisms of the lock in positions corresponding to a closed and locked state of the lock, the external opening lever of the lock being illustrated in the position of rest.
Figure 4:
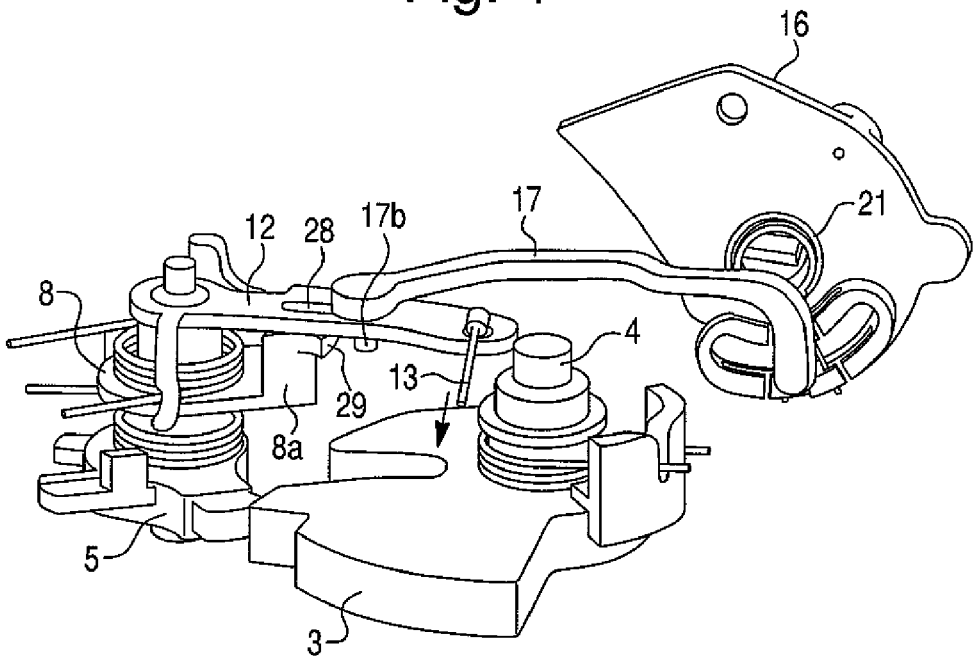
FIG. 4 is a perspective view similar to that of FIG. 3, after the external opening lever has been brought into the opening position, the lock still being in a closed and locked state.
Figure 5:
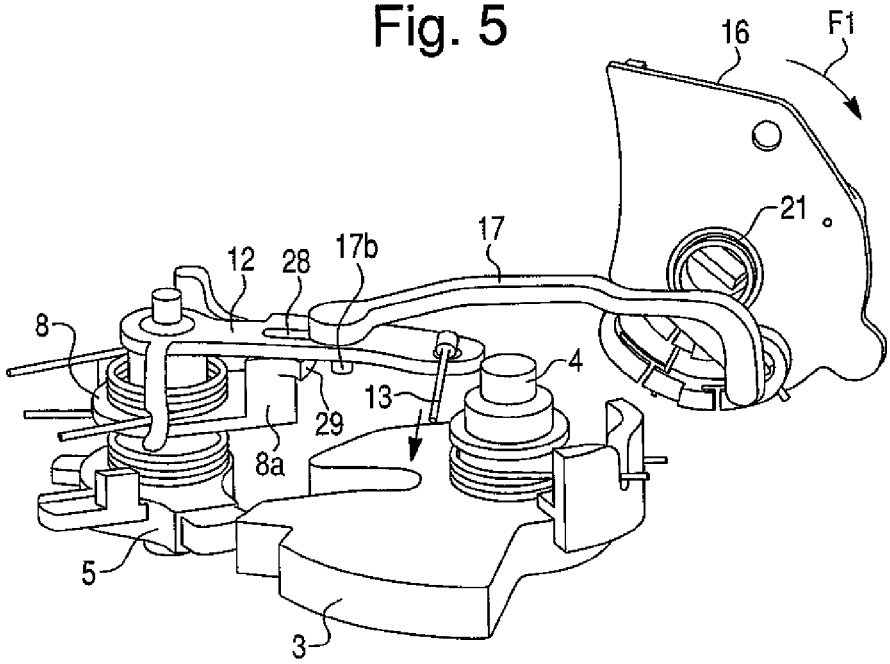
FIG. 5 is a perspective view similar to FIG. 4, after the locking lever of the lock has been brought into an unlocking position.

Starting from the situation illustrated in FIG. 3, in which the lock is in a closed and locked state, it is assumed that a user actuates the external handle or keeper, not shown, which is connected by means of the force transmission member 13 to the external opening lever 12 of the lock, for the purpose of opening the corresponding vehicle door. Under these conditions, the external opening lever 12 assumes the position shown in FIG. 4, and the coupling stud 17*b* comes into place in front of the tab 8*a* of the dummy pawl 8, without acting on said tab, hence without causing the opening of the lock. If, at this moment, the locking lever 16 is displaced angularly clockwise, as indicated by the arrow F1 in FIG. 5, in order to change from the locking position to the unlocking position, the connecting rod 17 remains blocked substantially in the same position as that of FIG. 4, since the coupling stud 17*b* of this rod comes to bear against a stop surface 29 of the tab 8*a* of the dummy pawl 8. The result of this is that, at this moment, the lock is not unlocked.

Figure 6:
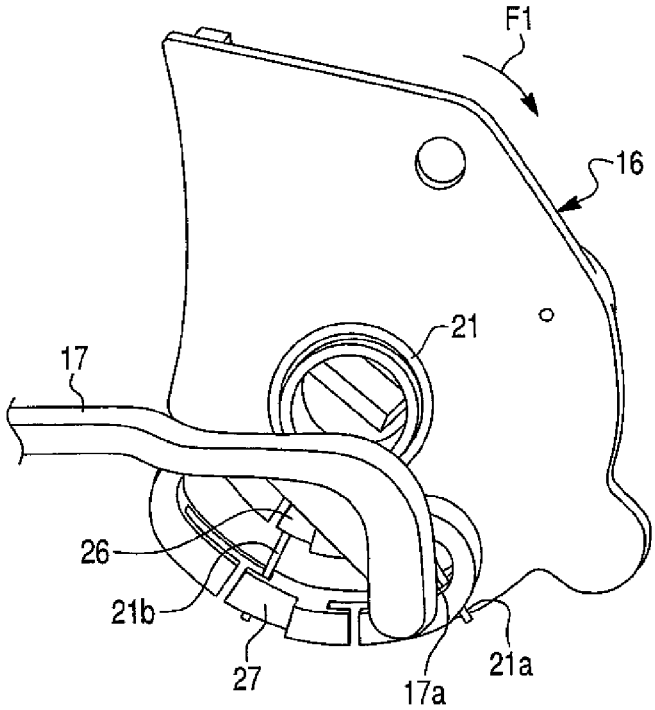
FIG. 6 is a view showing a detail of FIG. 5 on a larger scale.

However, during the rotation of the locking lever 16 in the direction of the arrow F1, since the connecting rod 17 is blocked by the stop surface 29 of the tab 8*a* of the dummy pawl 8, the coupling stud 17*a* of the connecting rod 17 retains the branch 21*a* of the spring 21, while the drive parts 26 and 27 of the locking lever 16 drive the branch 21*b* of the spring, at the same time moving it away from the branch 21*a*, as shown in FIG. 6. The result of this is that the spring 21 stores energy, thus memorizing the unlocking action.

As soon as the user releases the external handle or keeper of the door, the external opening lever 12 of the lock is returned into its position of rest (FIG. 7) by means of the spring 14. During the pivoting movement of the external opening lever 12 about the shaft 6 toward its position of rest, the lever 12 causes the coupling stud 17*b* of the connecting rod 17 to slide tangentially along the stop surface 29 of the tab 8*a* of the dummy pawl 8. As soon as the coupling stud 17*b* leaves the stop surface 29 and the latter is no longer an obstacle to a displacement of the coupling stud 17*b* radially toward the shaft 6, in the oblong slot 28 of the external opening lever 12, the connecting rod 17 is pushed by the branch 21*a* of the spring 21 which returns the energy, which it had stored during the rotation of the locking lever 16, in the direction of the arrow F1. The result of this is that the connecting rod 17 assumes the position shown in FIG. 7, corresponding to a closed, but unlocked state of the lock. In this state, the user can actuate the external handle or keeper of the door once again in order to bring the external opening lever 12 into its opening position, as shown in FIG. 8. Since the lock is at this moment in an unlocked state, the coupling stud 17*b* of the connecting rod 17 acts on the tab 8*a* of the dummy pawl 8 and causes the latter, and also the pawl 5, to pivot clockwise, as indicated by the arrow F2 in FIG. 8. The result of this is that the pawl 5 releases the latch 3 which, in turn, pivots about the shaft 4 under the action of the branch 9*a* of the spring 9, in order to release the striker and make it possible to open the door.

Figure 7:
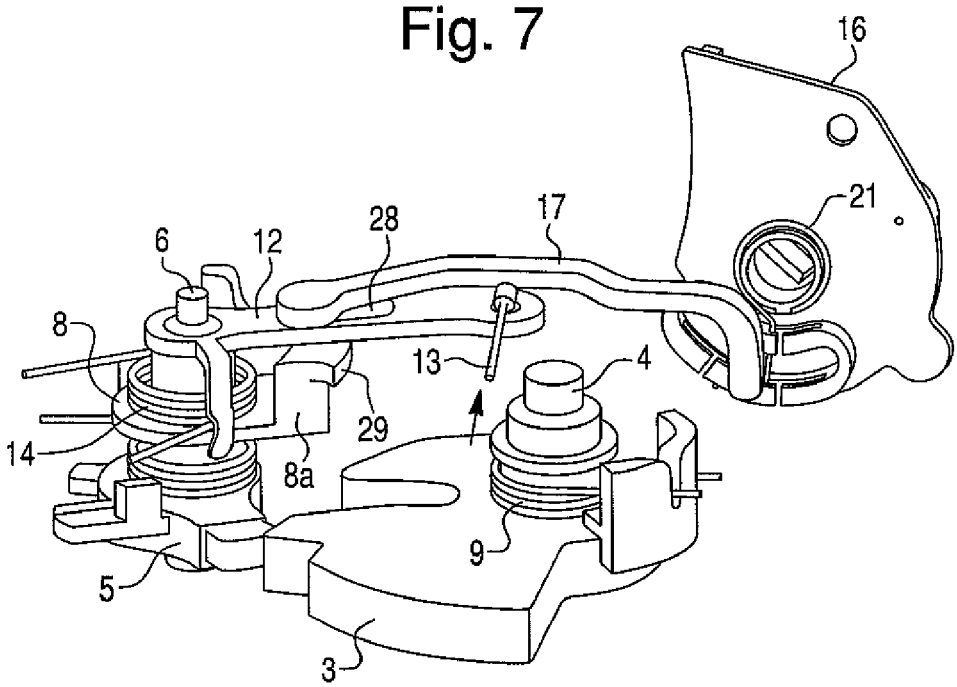
FIG. 7 is a perspective view similar to FIG. 5, after the external lever has been released, the lock being in a closed and unlocked state.
Figure 8:
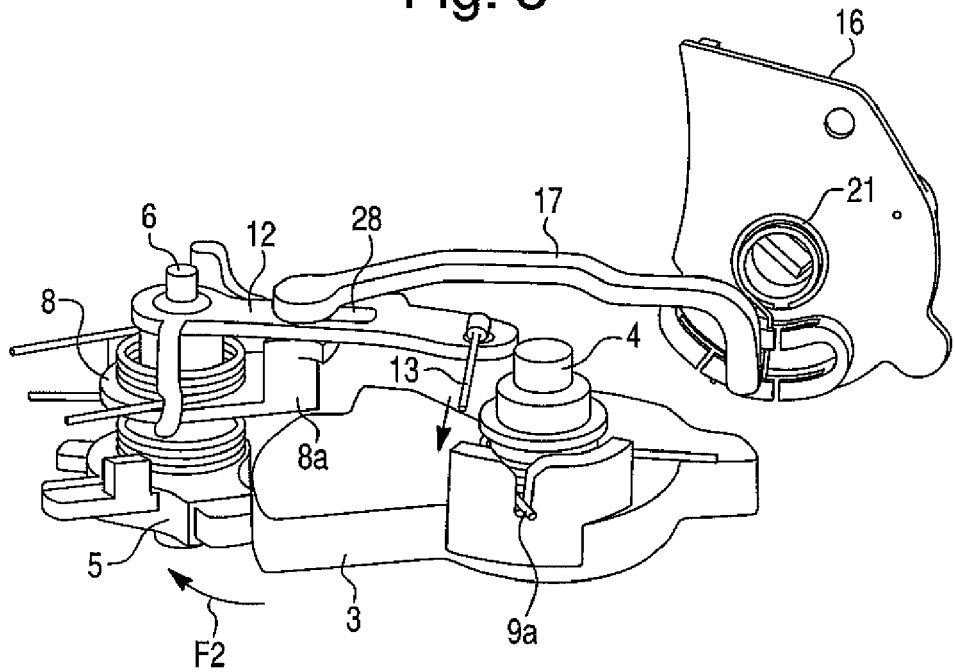
FIG. 8 is a perspective view similar to FIG. 7, the lock being in an unlocked and opened state, after the external opening lever has been actuated.

Starting from the situation illustrated in FIG. 7, which corresponds to the closed and unlocked state of the lock, it is now assumed that a user actuates the external handle or keeper of the door for the purpose of opening the latter, just before the vehicle driver executes a locking action, for example with the aid of his key or his remote control. Under these conditions, the external opening lever 12 changes into the position shown in FIG. 8 and causes the opening of the lock in the way already explained above.

Figure 9:
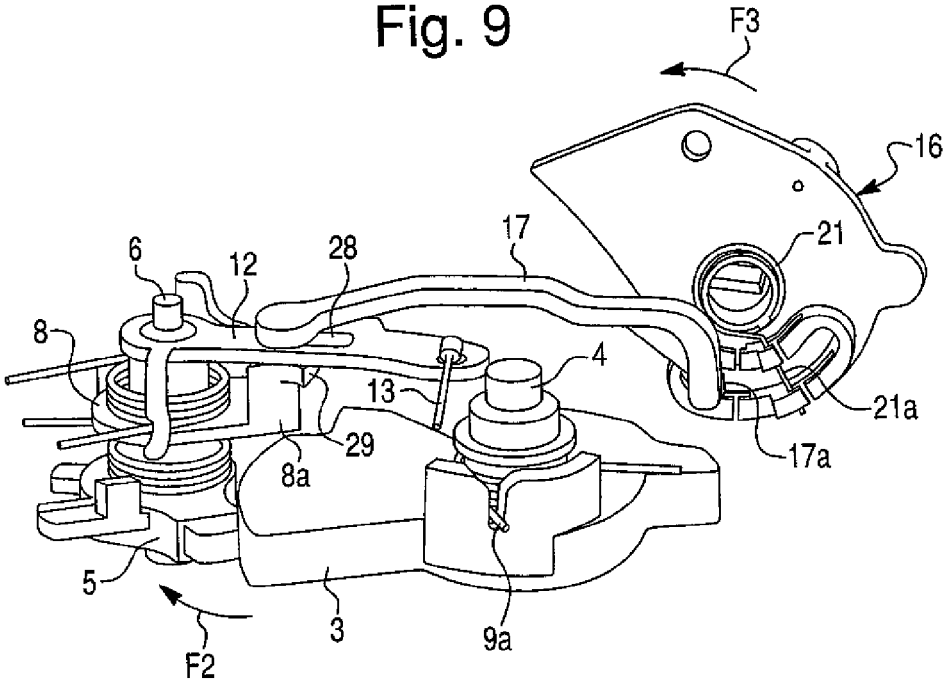
FIG. 9 is a perspective view similar to FIG. 8, after the locking lever of the lock has been brought into a locking position.

If, while the external opening lever 12 is being maintained in the opening position shown in FIGS. 8 and 9, the locking lever 16 is rotated counterclockwise, as indicated by the arrow F3 in FIG. 9, from the unlocking position to the locking position, the connecting rod 17 remains blocked in the same position as that of FIG. 8. To be precise, when the external opening lever 12 is in the opening position, the oblong slot 28 of said lever 12 occupies a highly oblique position with respect to the direction of action of the tractive force exerted on the connecting rod 17 by the locking lever 16 and the spring 21. The result of this is that one of the two longitudinal edges of the slot 28 of the lever 12 retains the coupling stud 17*b* of said connecting rod, thus preventing the lock from changing to a locked state.

Figure 10:
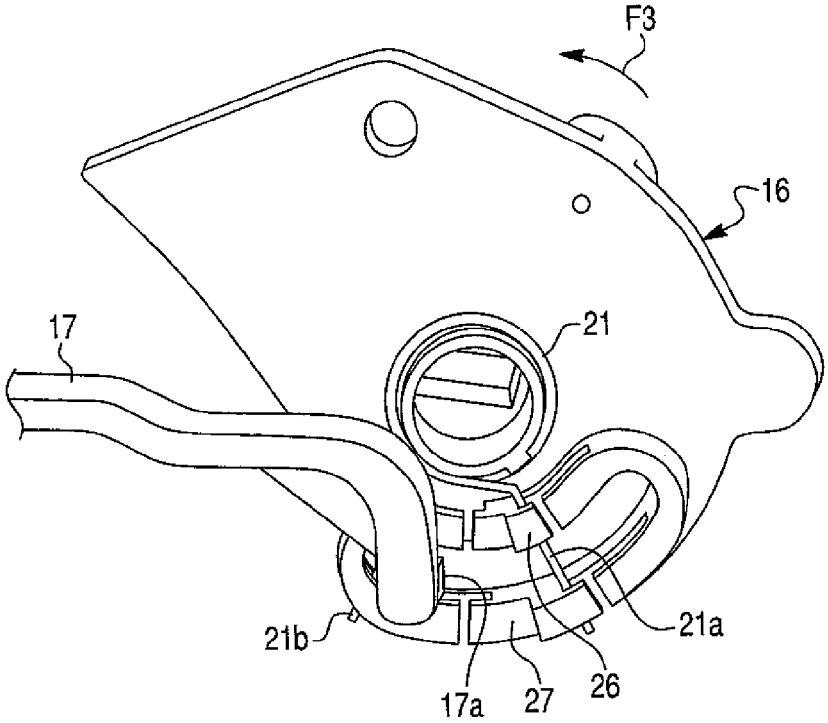
FIG. 10 shows a detail of FIG. 9 on a larger scale.

However, since the connecting rod 17 remains blocked by the external opening lever 12 during the rotation of the locking lever 16 in the direction of the arrow F3, the coupling stud 17*a* of said connecting rod retains the branch 21*b* of the spring 21 while the drive parts 26 and 27 of the locking lever 16 push the branch 21*a* of the spring 21, at the same time moving it away from the branch 21*b*, as shown in FIG. 10. The result of this is that, here too, the spring 21 stores energy and thus memorizes the locking action.

Figure 11:
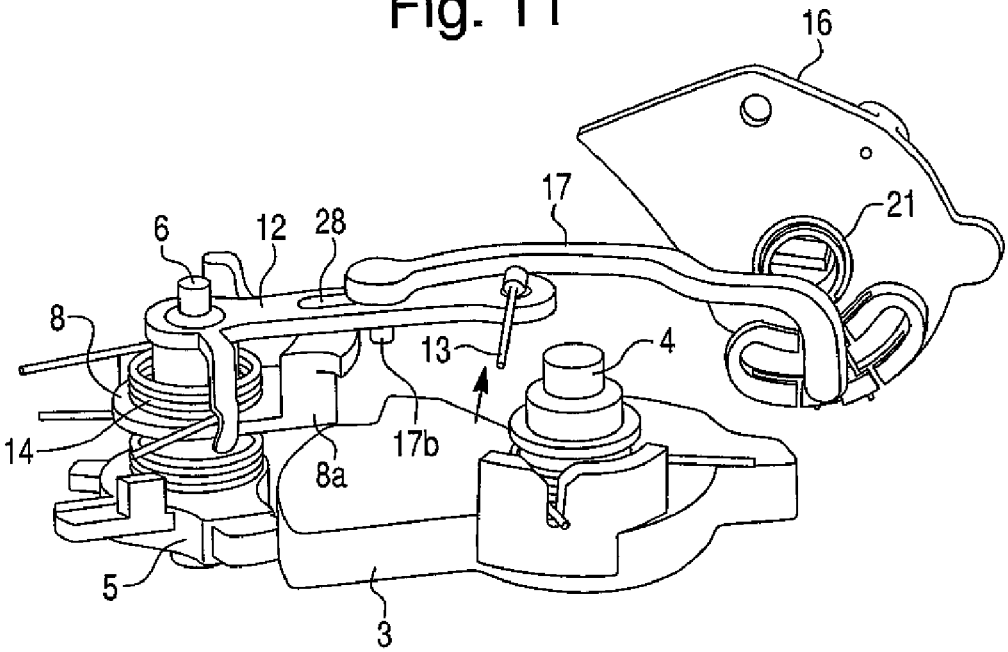
FIG. 11 is a perspective view similar to FIG. 9, after the release of the external opening lever, the lock being in an opened and locked state.
Figure 12:
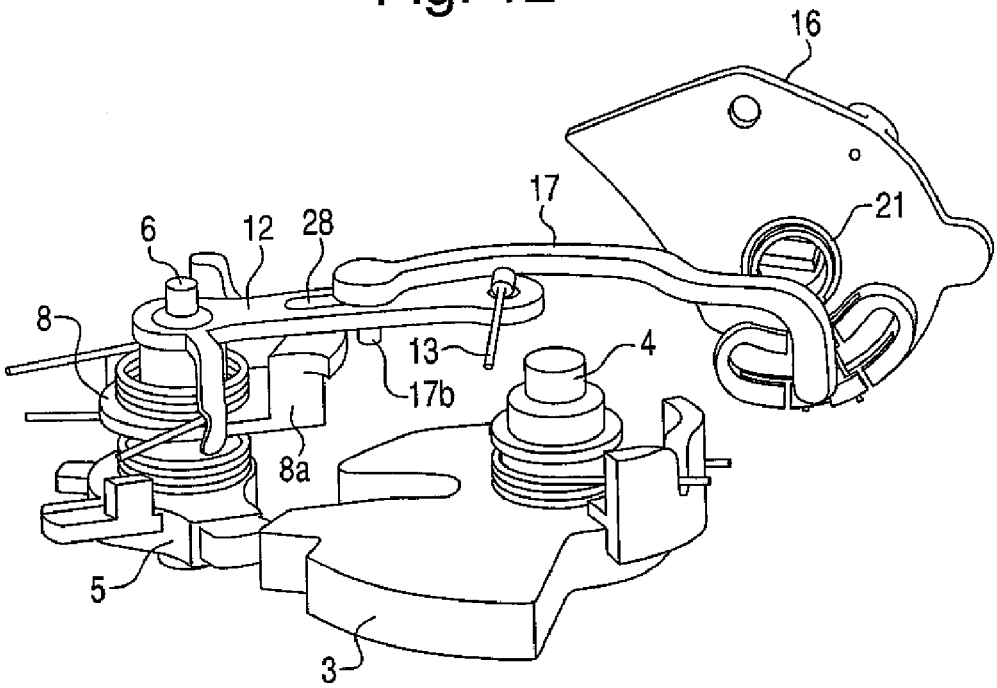
FIG. 12 is a perspective view similar to FIG. 11, the lock being in a closed and locked state after the door carrying the lock has been slammed shut.

As soon as the user releases the external handle or keeper of the door, the external opening lever 12 is returned into its position of rest by means of the spring 14, as shown in FIG. 11. In this position, the oblong slot 28 of the external opening lever 12 extends substantially in the direction of action of the tractive force exerted on the connecting rod 17 by the branch 21*b* of the spring 21. The result of this is that the coupling stud 17*b* of said connecting rod is free to be displaced in the oblong slot 28, thus allowing the spring 21 to return the locking energy which it had stored during the rotation of the locking lever 16 in the direction of the arrow F3, in order to bring the connecting rod into the position shown in FIG. 11. The lock is then in an opened, but potentially locked state. To be precise, if the door has been opened, it is subsequently sufficient to slam the door shut in order to ensure that the lock automatically changes to the closed and locked state illustrated in FIG. 12, that is to say to a situation identical to that shown in FIG. 3.

It goes without saying that the embodiment of the invention which was described above has been given by way of a purely illustrative and in no way limiting example, and that numerous modifications may easily be made by a person skilled in the art, without thereby departing from the scope of the invention.

For example, it is not absolutely essential that the branches 21*a* and 21*b* of the spring 21 be crossed. It is sufficient, for this purpose, to use a helical torsion spring, of which the winding direction around the hub 16*a* of the locking lever 16 is reversed with respect to the winding direction of the spring 21 shown in FIG. 2.

The advantage can be seen of using a spring with two branches, of which one 21*a* of the branches serves for driving the connecting rod 17 from its second inactive position to its first active position and of which the other 21*b* of the two branches serves for driving the connecting rod 17 from its first active position to its second inactive position. To be precise, this arrangement makes it possible to implement two functions simultaneously in an economical and relatively compact way.

Furthermore, instead of using a helical torsion spring as an elastic device for storing an unlocking or locking energy, an elastic member, for example a helical compression spring, may be provided in the arcuate slot 18 on each side of the coupling stud 17*a*, between the latter and each of the ends of said arcuate slot. In this case, the elastic member may be subjected to compressive prestress.

Although the preceding description described the lever 12 as an external opening lever, this could be an internal opening lever intended to be connected by means of a force transmission member to an internal opening control member (internal handle or keeper) of a motor vehicle door.

Alternatively, the lever 12 can be an intermediate lever capable of being actuated both by an external opening lever and by an internal opening lever of a lock.

The invention claimed is:

1. A lock for an opening on a motor vehicle, comprising:

a latch (3);

a pawl (5) capable of retaining the latch (3) in a position corresponding to a closed state;

an opening lever (12) movable between an opening position and a rest position upon actuation by a user;

a locking lever (16) moveable between a first position corresponding to an unlocked state and a second position corresponding to a locked state, a connecting rod (17) connecting the locking lever and the opening lever, said connecting rod being displaceable between a first active position for operatively engaging the opening lever (12) to the latch (3) to establish the unlocked state and a second inactive position for operatively disengaging the opening lever (12) from the latch (3) to establish the locked state in response to displacement of the locking lever (16) between the first and second positions, a blocking member (28, 29) on a dummy pawl (8) adjacent to and mechanically connected to the locking lever for blocking the connecting rod in the first active position, said dummy pawl (8) adapted to move said pawl (5), and an elastic device (21) storing a locking energy when the blocking member blocks the connecting rod (17) in the first active position and the locking lever (16) is moved from the first position to the second position while the opening lever (12) is in the opening position, wherein movement of the opening lever (12) from the opening position to the rest position unblocks the connecting rod from the blocking member and causes a release of the locking energy to displace the connecting rod from the first active position to the second inactive position.

2. The lock as claimed in claim 1, wherein the elastic device (21) stores an unlocking energy when the blocking member (28, 29) blocks the connecting rod (17) in the first active position and the locking lever (16) is moved from the second position to the first position while the opening lever (12) is in the opening position, wherein movement of the opening lever (12) from the opening position to the rest position unblocks the connecting rod from the blocking member and causes a release of the unlocking energy to displace the connecting rod from the second inactive position to the first active position.

3. The lock as claimed in claim 2, characterized in that the elastic device (21) comprises a helical torsion spring with two branches (21*a*, 21*b*) which connects the locking lever (16) directly to the connecting rod (17).

4. The lock as claimed in claim 3, wherein one (21*a*) of the branches drives the connecting rod (17) from the second inactive position to the first active position, and the other (21*b*) of the two branches drives the connecting rod (17) from the first active position to the second inactive position.

5. The lock as claimed in claim 3, wherein the two branches (21*a*, 21*b*) of the helical torsion spring (21) are crossed, as seen in the axial direction.

6. The lock as claimed in claim 5, wherein the locking lever (16) has substantially the form of a disk comprising a central hub (16*a*), a slot (18) which is formed in the disk and which extends in an arc of a circle about a part of the central hub (16*a*), and at least one drive part (26, 27) which projects on a face of the disk mid-way along at least one longitudinal edge of the arcuate slot (18).

7. The lock as claimed in claim 6, wherein the helical torsion spring (21) is arranged around the central hub (16*a*) of the locking lever (16), said drive part (26, 27) of the locking lever (16) is gripped between the two branches (21*a*, 21*b*) of said helical torsion spring (21) and the two branches (21*a*, 21*b*) pass radially through the arcuate slot (18).

8. The lock as claimed in claim 7, wherein the connecting rod (17) comprises a first coupling stud (17*a*) and a second coupling stud (17*b*) disposed at a first end and an opposite second end thereof, respectively, said first coupling stud (17*a*) passing through the arcuate slot (18) of the locking lever (16) between the two branches (21*a*, 21*b*) of the helical torsion spring (21), said second coupling stud (17*b*) passing through an oblong slot (28) formed longitudinally in the opening lever (12), said oblong slot (28) extending in a first direction for allowing displacement of the connecting rod (17) from the first active position to the second inactive position when the opening lever (12) is moved to the rest position, the oblong slot (28) further extending in a second direction preventing said displacement of the connecting rod (17) when the opening lever (12) is in the opening position.

9. The lock as claimed in claim 7, further comprising: and an opening control means (13) coupled to the opening lever (12) to control movement of the opening lever (12) between the rest position and the opening position, the pawl (5), the dummy pawl (8) and the opening lever (12) being mounted in succession on a common pivoting shaft (6), the dummy pawl (8) being integral in terms of rotation with the pawl (5), and a tab (8*a*) on which the a second coupling stud (17*b*) of the connecting rod (17) acts in order to cause the displacement of the dummy pawl (8) and of the pawl (5) toward a release position of the latch (3) when the connecting rod (17) is in the first active position and the opening lever (12) is displaced from the rest position to the opening position.

10. The lock as claimed in claim 9, wherein said blocking member comprises a stop surface (29) of said tab (8*a*).

11. The lock as claimed in claim 9, wherein the opening lever (12) is an external opening lever connected to an external opening control of a motor vehicle door via a force transmission member (13).

12. The lock as claimed in claim 1, wherein the elastic device (21) comprises a helical torsion spring with two branches (21*a*, 21*b*) which connects the locking lever (16) directly to the connecting rod (17).

13. The lock as claimed in claim 4, wherein the two branches (21*a*, 21*b*) of the helical torsion spring (21) are crossed, as seen in the axial direction.

14. The lock as claimed in claim 10, wherein the opening lever (12) is an external opening lever connected to an external opening control of a motor vehicle door via a force transmission member (13).

15. A locking assembly for a motor vehicle, comprising:

a motor vehicle latch (3);

a pawl (5) capable of retaining the latch (3) in a position corresponding to a closed state;

an opening lever associated with an external handle of a motor vehicle latch to be operated by a user and being movable between an open position for unlatching the motor vehicle latch and a closed position for latching the motor vehicle latch;

a locking lever movable between a locking position for locking the motor vehicle latch and unlocking position for unlocking the motor vehicle latch;

an elastic device associated with said locking lever for storing locking energy and unlocking energy for locking and unlocking the motor vehicle latch, respectively; and a connecting rod operably disposed between said opening lever and said locking lever for applying the unlocking energy to said elastic device when said opening lever is in the open position and said locking lever is moved to the unlocking position, the unlocking energy applied to said elastic device being released so as to unlock the motor vehicle latch when said opening lever is released, and for applying the locking energy to said elastic device when said opening lever is in the open position and said locking lever is moved to the locking position, the locking energy applied to said elastic device being released so as to lock the motor vehicle latch when said opening lever is released, wherein said locking assembly further comprises a dummy pawl having a blocking element for selectively engaging a first end of said connecting rod, said first end of said connecting rod being movable between an inactive position in which said first end does not engage said blocking element when the motor vehicle latch is locked and an active position in which said first end engages said blocking element when the motor vehicle latch is unlocked, and a second end of said connecting rod engages said elastic device such that said elastic device transfers the unlocking energy or the locking energy stored therein to move said connecting rod to the active position or the inactive position, respectively, based on the movement of said locking lever when said opening lever is in an open position and is then released.

* * * * *